US006935085B2

(12) United States Patent
Little, Jr.

(10) Patent No.: US 6,935,085 B2
(45) Date of Patent: Aug. 30, 2005

(54) UNIVERSAL STUD FOR DEMOUNTABLE WALL PARTITIONS AND DEMOUNTABLE CEILING PANELS

(76) Inventor: William Franklin Little, Jr., 28922 Clearbrook La., Magnolia, TX (US) 77355

( * ) Notice: Subject to any disclaimer, the term of this patent is extended or adjusted under 35 U.S.C. 154(b) by 0 days.

(21) Appl. No.: 10/713,414

(22) Filed: Nov. 14, 2003

(65) Prior Publication Data

US 2004/0118061 A1 Jun. 24, 2004

Related U.S. Application Data

(63) Continuation of application No. 09/502,704, filed on Feb. 11, 2000, now abandoned.

(51) Int. Cl.[7] ..... E04C 3/30
(52) U.S. Cl. ..... 52/731.7; 52/582.1; 52/285.1
(58) Field of Search ..... 52/285.1, 562, 52/582.1, 275, 731.7, 731.8, 731.9, 737.6, 762, 763, 782.1

(56) References Cited

U.S. PATENT DOCUMENTS 1,413,828 A * 4/1922 Burns ..... 52/356
3,866,364 A * 2/1975 Pollard ..... 52/36.5
4,689,930 A * 9/1987 Menchetti ..... 52/277
4,712,942 A * 12/1987 Brown ..... 403/174
4,840,440 A * 6/1989 Dieter ..... 312/140
4,841,707 A * 6/1989 Novoa ..... 52/426
4,964,252 A * 10/1990 Guliker ..... 52/275
6,006,480 A * 12/1999 Rook ..... 52/309.12
6,341,458 B1 * 1/2002 Burt ..... 52/287.1

* cited by examiner

*Primary Examiner*—Naoko Slack
(74) *Attorney, Agent, or Firm*—Alton W. Payne

(57) ABSTRACT

A universal stud for use with demountable wall partitions and demountable ceiling panels is provided. A base having a first end and a second end is provided. The base has sufficient structure for removably engaging a demountable wall partition and/or a demountable ceiling panel. A plurality of arms extend from the base. Two arms and the base define a channel for receiving either the demountable wall partition or the demountable ceiling panel. The universal stud can be oriented vertically to accept a demountable wall partition, or, can be oriented horizontally to receive either the demountable wall partition or the demountable ceiling panel.

8 Claims, 2 Drawing Sheets

UNIVERSAL STUD FOR DEMOUNTABLE WALL PARTITIONS AND DEMOUNTABLE CEILING PANELS

CROSS REFERENCE TO RELATED APPLICATION

This application is a continuation application of and claims the benefit of U.S. patent application Ser. No. 09/502,704 entitled, "Universal Stud For Demountable Wall Partitions And Demountable Ceiling Panels," filed Feb. 11, 2000 now abandoned.

FIELD OF THE INVENTION

The present invention relates generally to wall structures, ceiling structures and a stud for both.

BACKGROUND OF THE INVENTION

Many wall and ceiling structures are available. A stud device is described in U.S. Pat. No. 4,570,390 to Wendt. Another related stud system is described in U.S. Pat. No. 5,287,675 to McGee. A ceiling device is described in U.S. Pat. No. 5,937,605 to Wendt. All known stud, wall and ceiling systems require different and varied components.

It is, therefore, a feature of the present invention to provide a universal stud adaptable for use with both ceiling panels and wall partitions.

Additional features and advantages of the invention will be set forth in part in the description which follows, and in part will become apparent from the description, or may be learned by practice of the invention. The features and advantages of the invention may be realized by means of the combinations and steps particularly pointed out in the appended claims.

SUMMARY OF THE INVENTION

To achieve the foregoing objects, features, and advantages and in accordance with the purpose of the invention as embodied and broadly described herein. A universal stud for use with demountable wall partitions and demountable ceiling panels is provided. A base having a first end and a second end is provided. The base has sufficient structure for removably engaging a demountable wall partition and/or a demountable ceiling panel. A plurality of arms extend from the base. Two arms and the base define a channel for receiving either the demountable wall partition or the demountable ceiling panel. The universal stud can be oriented vertically to accept a demountable wall partition, or, can be oriented horizontally to receive either the demountable wall partition or the demountable ceiling panel.

BRIEF DESCRIPTION OF THE DRAWINGS

The accompanying drawings which are incorporated in and constitute a part of the specification, illustrate a preferred embodiment of the invention and together with the general description of the invention given above and the detailed description of the preferred embodiment given below, serve to explain the principles of the invention.

The above general description and the following detailed description are merely illustrative of the generic invention, and additional modes, advantages, and particulars of this invention will be readily suggested to those skilled in the art without departing from the spirit and scope of the invention.

DETAILED DESCRIPTION OF THE PREFERRED EMBODIMENTS

Reference will now be made in detail to the present preferred embodiments of the invention as described in the accompanying drawings.

Figure 1:
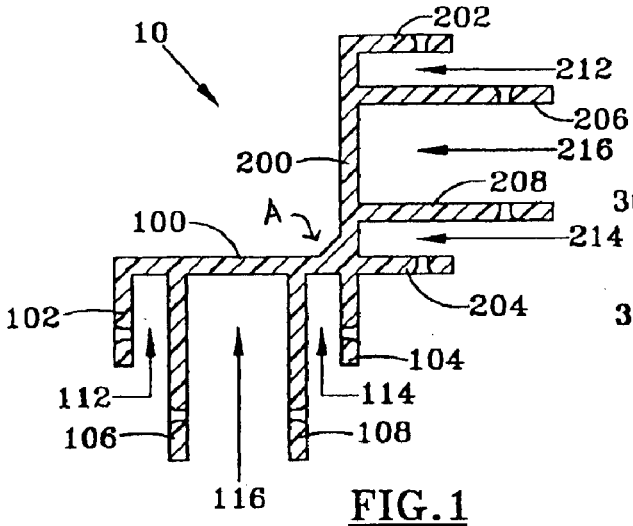
FIG. 1 is a plan view of a preferred embodiment of an angle connector encompassed by the present invention.

FIG. 1 illustrates an angle connector 10 associated with the present invention. The angle connector 10 has a first base 100 and a second base 200. The first base 100 and the second base 200 are connected at an angle A. The first base 100 comprises a first arm 102, a second arm 104, a third arm 106 and a fourth arm 108. The first arm 102, the second arm 104, the third arm 106 and the fourth arm 108 extend from the base 100 along the same dimension. The first arm 102 and the second arm 104 are located at the extreme ends of the first base 100. The third arm 106 and the fourth arm 108 are located at intermediate locations extending from the first base 100 and between the first arm 102 and the second arm 104. An outer channel 112 is formed by the first arm 102, the first base 100 and the third arm 106. Similarly, an inner channel 114 is formed by the arrangement of the second arm 104, the first base 100 and the fourth arm 108. A center channel 116 is formed by the third arm 106, the first base 100 and the fourth arm 108. The partition can be made of any material or materials, such as by way of example, wood, fiberglass, plexiglass, glass, metal, fabric-wrapped material, plastic, sheetrock, composite material and the like.

The second base 200 has connected thereto a first arm 202, a second arm 204, a third arm 206 and a fourth arm 208. The arrangement of the first arm 202, the second base 200 and the third arm 206 form an outer channel 212. Similarly, the second arm 204, the second base 200 and the fourth arm 208 form an inner channel 214. A center channel 216 is formed by the third arm 206, the second base 200 and the fourth arm 208.

The angle connector 10 can be used in various configurations. It should be appreciated by those skilled in the art that the angle A can be changed such that the orientation of the arms and associated channels can be located at varying dimensions.

Figure 2:
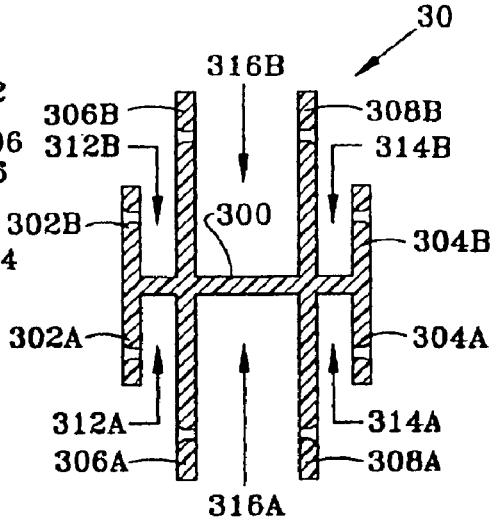
FIG. 2 is a plan view of a preferred embodiment of a straight connector encompassed by the present invention.

FIG. 2 is an illustration of a straight connector 30 associated with the present invention. The straight connector 30 comprises a base 300 with a plurality of symmetrical arms extending remotely therefrom. At the extremity of the straight connector 30 are the first arms 302A, 302B and the second arms 304A, 304B. Located intermediate of the first arms 302A, 302B and the second arms 304A, 304B are the third arms 306A, 306B and the fourth arms 308A, 308B. Symmetrically corresponding channels are formed by the orientation of the various arms with the base 300. A first channel 312A is formed by the first arm 302A, the base 300 and the third arm 306A. A center channel 316A is formed by the third arm 306A, the base 300 and the fourth arm 308A. A second channel 314A is formed by the fourth arm 308A, the base 300 and the second arm 304A. A fourth channel 314B is formed by the second arm 304B, the base 300 and the fourth arm 308B. A center channel 316B is formed by the third arm 306B, the base 300 and the fourth arm 308B. A sixth channel 312B is formed by the first arm 302B, the base 300 and the third arm 306B.

Figure 3:
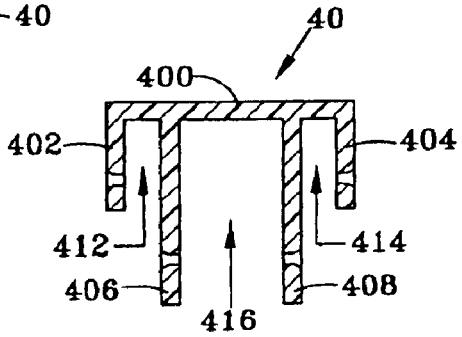
FIG. 3 a plan view of a preferred embodiment of a cap connector encompassed by the present invention.

FIG. 3 is an illustration of a cap connector 40 associated with the present invention. The cap connector 40 comprises a base 400 and a plurality of arms extending from the base 400. A first arm 402 and a second arm 404 are located at the extremities of the base 400. Between the first arm 402 and the second arm 404 are a third arm 406 and fourth arm 408. A first channel 412 is formed by the first arm 402, the base 400 and the third arm 406. A second channel 414 is formed by the second arm 404, the base 400 and the fourth arm 408. A center channel 416 is formed by the third arm 406, the base 400 and the fourth arm 408.

Figure 4:
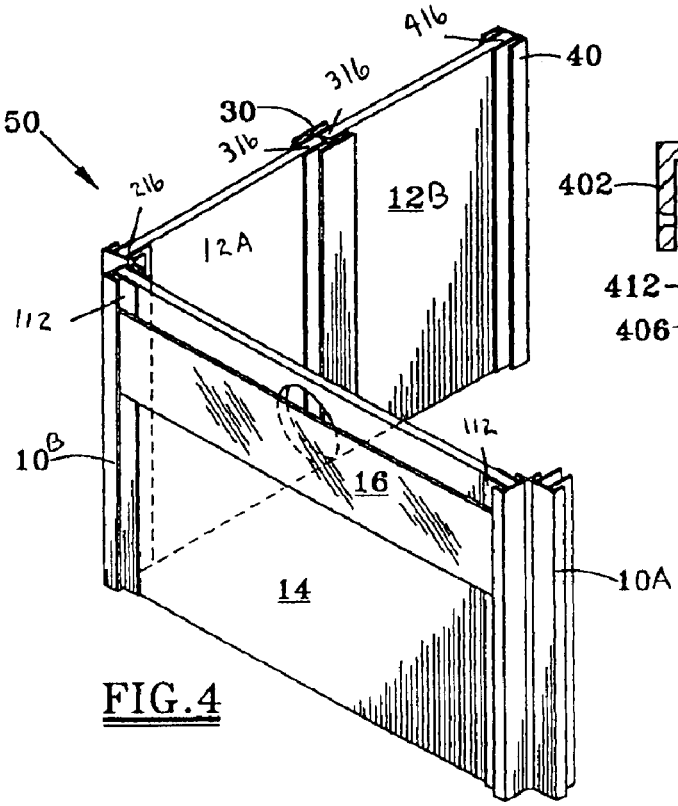
FIG. 4 is a perspective view of a preferred embodiment of a wall structure encompassed by the present invention.

FIG. 4 is a partial illustration showing use of the angle connector 10, the straight connector 30 and the cap connector 40 in association with several partitions 12, 14 and 16. Particularly, partition 14 is engaged in a center channel 116, 216 of a first angle connector 10A and a second angle connector 10B. A sliding partition 16 is engaged in the corresponding outer channels 112 of the angle connectors 10A, 10B. Also, a partition 12A is engaged with the center channel 216 of the angle connector 10B and the center channel 316 of the straight connector 30. The straight connector 30 is engaged by its alternate center channel 316 with a partition 12B. The partition 12B is further engaged with the center channel 416 of a cap connector 40. The partition can be made of any material or materials, such as by way of example, wood, fiberglass, plexiglass, glass, metal, fabric-wrapped material, plastic, sheetrock, composite material and the like. Any means for removably securing the stud to the partition such as for example, without limitation, screws, nails, removable pins, adhesive, releasable adhesive, caulk, straps and the like.

Figure 5:
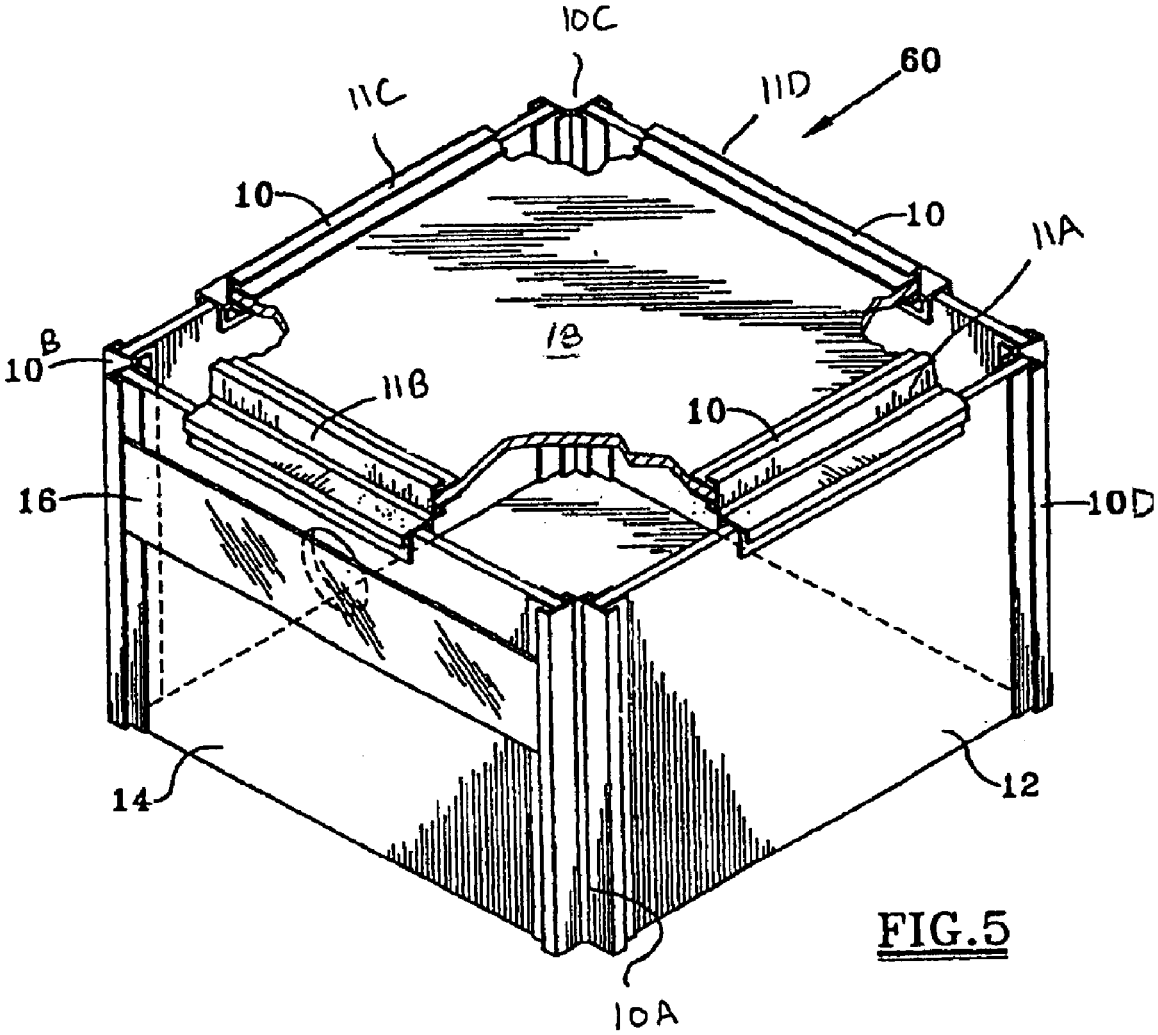
FIG. 5 is a perspective view of a preferred embodiment of a wall and ceiling structure encompassed by the present invention.

FIG. 5 is an illustration of an enclosed structure 60 using the angle connectors 10 of the present invention. FIG. 5 illustrates a first side partition 12 and a second side partition 14 and two other side partitions (not illustrated) being held in a fixed geometric shape using the angle connectors 10A, 10B, 10C, 10D. The side partitions 12, 14 and connectors 10A, 10B, 10C, 10D are further engaged in an upper partition 18 using additional angle connectors 11A, 11B, 11C, 11D.

It can be appreciated by those skilled in the art that various configurations can be formed using the connector system and method of the present invention. Differing angles can be used with the angle connector 10 to achieve different geometries. Partitions can be shortened and longated using the straight connector 30 and sliding members can be removably or slidably engaged with the angle connector 10 or the straight connector 30 or the cap connector 40.

Additional advantages and modification will readily occur to those skilled in the art. The invention in its broader aspects is therefore not limited to the specific details, representative apparatus, and the illustrative examples shown and described herein. Accordingly, the departures may be made from the details without departing from the spirit or scope of the disclosed general inventive concept.

What is claimed is:

1. A universal stud for use with demountable wall partitions and demountable ceiling panels comprising (a) at least one base having a first end and a second end, the base having sufficient structure for removably engaging only one of a demountable wall partition and a demountable ceiling panel, and (b) a plurality of arms extending from the base such that two arms and the base define a channel for receiving one of the demountable wall partition and the demountable ceiling panel, wherein the plurality of arms comprises (1) a first arm extending from the first end of the base, (2) a second arm extending from the second end of the base, (3) a third arm extending from the base closer to the first arm than the second arm, (4) a fourth arm extending from the base closer to the second arm than the first arm and between the third arm and the second arm, such that (5) an exterior channel is defined by the first arm, the third arm and the base therebetwen, (6) an interior channel is defined by the third arm, the fourth arm and the base therebetwen, (7) an inner channel is defined by the fourth arm and the second arm, whereby the channels receive and removeably secure at least one of the demountable wall partition and the demountable ceiling panel between the channels such that the universal stud can be oriented to accept a demountable wall partition, or, can be oriented to receive at least one of the demountable wall partition and the demountable ceiling panel, and the universal stud further comprising:

(a) a second base having a first end and a second end, the base having sufficient structure for removably engaging at least one of the demountable wall partition and the demountable ceiling panel, with the second end of the second base fixedly secured to the second end of the first base at a predefined angle, (b) a plurality of arms extending from the second base, the plurality of arms comprising (1) a first arm extending from the first end of the base.

(2) a second arm extending from the second end of the base, (3) a third arm extending from the base closer to the first arm than the second arm, (4) a fourth arm extending from the base closer to the second arm than the first arm and between the third arm and the second arm, such that (5) an exterior channel is defined by the first arm, the third arm and the base therebetwen (6) an interior channel is defined by the third arm, the fourth arm and the base therebetwen (7) an inner channel is defined by the fourth arm and the second arm whereby the channels receive and removeably secure at least one of the demountable wall partition and the demountable ceiling panel between the channels.

2. The universal stud for use with demountable wall partitions and demountable ceiling panels as defined in claim 1 further comprising means for removably securing the stud to the partition.

3. The universal stud for use with demountable wall partitions and demountable ceiling panels as defined in claim 2 wherein the means for removably securing the stud to the partition adapted to be selected from the group consisting of screws, nails, removable pins, adhesive, releasable adhesive, caulk and straps.

4. The universal stud for use with demountable wall partitions and demountable ceiling panels as defined in claim 2 wherein one demountable wall partition or demountable ceiling panel is used.

5. The universal stud for use with demountable wall partitions and demountable ceiling panels as defined in claim 2 wherein two demountable wall partitions or demountable ceiling panels are used such that a space is created therebetween.

6. The universal stud for use with demountable wall partitions and demountable ceiling panels as defined in claim 5 wherein two demountable wall partitions or demountable ceiling panels are used with additional materials disposed in the space therebetween.

7. The universal stud for use with demountable wall partitions and demountable ceiling panels as defined in claim 2 wherein three demountable wall partitions or demountable ceiling panels are used such that a space is created therebetween.

8. The universal stud for use with demountable wall partitions and demountable ceiling panels as defined in claim 7 wherein three demountable wall partitions or demountable ceiling panels are used with additional materials disposed in the spaces therebetween.

* * * * *